US008794041B2

(12) United States Patent
Daniels

(10) Patent No.: US 8,794,041 B2
(45) Date of Patent: Aug. 5, 2014

(54) FLIP GUARD LOCK DEVICE AND METHOD OF USE

(71) Applicant: Ron R. Daniels, Missouri City, TX (US)

(72) Inventor: Ron R. Daniels, Missouri City, TX (US)

( * ) Notice: Subject to any disclaimer, the term of this patent is extended or adjusted under 35 U.S.C. 154(b) by 0 days.

(21) Appl. No.: 13/935,007

(22) Filed: Jul. 3, 2013

(65) Prior Publication Data

US 2014/0007632 A1 Jan. 9, 2014

Related U.S. Application Data

(60) Provisional application No. 61/668,288, filed on Jul. 5, 2012.

(51) Int. Cl.
*E05B 13/04* (2006.01)

(52) U.S. Cl.
USPC ..... 70/211; 70/416; 70/429

(58) Field of Classification Search
USPC ..... 70/416, 202, DIG. 30, 211, 212, 429, 70/430; 292/153, 359, 258, 288–298
See application file for complete search history.

(56) References Cited

U.S. PATENT DOCUMENTS

| | | | | | |
|---|---|---|---|---|---|
| 152,058 | A * | 6/1874 | Andrews | 70/429 |
| 588,758 | A * | 8/1897 | Smith | 70/429 |
| 1,700,135 | A * | 1/1929 | Lanes | 70/416 |
| 3,423,974 | A * | 1/1969 | Bernsley | 70/416 |
| 3,748,882 | A * | 7/1973 | Dusault et al. | 70/416 |
| 5,003,803 | A * | 4/1991 | Richards | 70/416 |
| 5,035,128 | A * | 7/1991 | Ridgway | 70/211 |
| 5,052,202 | A * | 10/1991 | Murphy | 70/211 |
| 5,313,812 | A * | 5/1994 | Eklund et al. | 70/416 |
| 5,369,971 | A * | 12/1994 | Sheppard | 70/416 |
| 5,515,704 | A * | 5/1996 | van Nguyen | 70/416 |
| 5,651,279 | A * | 7/1997 | Berton et al. | 70/211 |
| 5,950,465 | A * | 9/1999 | Schultz et al. | 70/416 |
| 6,301,941 | B1 * | 10/2001 | Nicholsfigueiredo | 70/211 |
| 6,481,252 | B2 | 11/2002 | Calle et al. | |
| 7,210,320 | B1 * | 5/2007 | Nokleberg | 70/211 |
| 7,805,967 | B1 * | 10/2010 | Agozzino et al. | 70/211 |
| 7,918,116 | B2 * | 4/2011 | Quach | 70/416 |
| 8,459,704 | B2 | 6/2013 | Daniels et al. | |
| 2004/0107752 | A1 * | 6/2004 | Hicks | 70/416 |
| 2009/0013739 | A1 * | 1/2009 | Vyskocil, Jr. | 70/416 |

* cited by examiner

*Primary Examiner* — Lloyd Gall
(74) *Attorney, Agent, or Firm* — Stephens & Domnitz, PLLC

(57) ABSTRACT

The present invention, and inventive system, is a new locking mechanism that prevents entry for doors, or other barriers that can use a deadbolt system, or system comparable to a deadbolt system. The present invention can be installed and works in conjunction with the existing deadbolt assembly to prevent lock picking, a bump key, or a user's own key from being used to open the door. In the present invention, by engaging the arm latch, or arm actuator, of the present invention, over the turn knob on an existing deadbolt, the present invention prevents the free rotation movement of the turn knob, thus not allowing retraction of the deadbolt, and entry through that door or barrier.

6 Claims, 2 Drawing Sheets

FLIP GUARD LOCK DEVICE AND METHOD OF USE

CROSS-REFERENCE TO RELATED APPLICATIONS

This application claims priority to U.S. provisional patent application 61/668,288, filed Jul. 5, 2012, which is incorporated by reference herein in its entirety.

STATEMENT REGARDING FEDERALLY SPONSORED RESEARCH

Not applicable

BACKGROUND

The present invention, and inventive system, is a new locking mechanism that prevents entry for doors, or other barriers that can be used a deadbolt system, or system comparable to a deadbolt system. The present invention can be installed and works in conjunction with the existing deadbolt assembly to prevent lock picking, bump keying, or a user's own key from being used to open the door. By engaging the arm latch, or arm actuator, of the present invention, over the turn knob on an existing deadbolt, the present invention prevents the free rotation movement of the turn knob, thus not allowing retraction of the deadbolt, and entry through, that door or barrier. U.S. Pat. No. 8,459,704 entitled "Security System for Entrance Barriers" issued on Jun. 11, 2013, to Daniels et at, discloses a flip hinge barrier lock attached to a door barrier either above, or below, an existing deadbolt assembly, the present invention, is distinguished from that prior art because the present invention utilizes a base plate that attaches behind the deadbolt face plate between the existing deadbolt faceplate and the door, and provides additional strength and ease of installation by utilizing the existing deadbolt assembly.

SUMMARY

In various embodiments, the present invention describes a system that reinforces an existing deadbolt assembly, or similar locking device by preventing the turn knob of the existing deadbolt assembly from rotating and thereby retracting an extended deadbolt. The present inventive system is designed to maximize a deadbolt door lock by providing a "lock out" feature at an affordable price, which can be installed easily and efficiently.

By reinforcing the existing deadbolt turn knob, the present invention disables the use of any key, a bump key or lock, picking key access by a person trying to gain, entrance through the door on the side of the key entry. In one embodiment of the present, invention, the present invention is surface mounted between, the existing deadbolt lock mechanism and the door. In this embodiment the present invention, uses the deadbolt screws of the existing deadbolt to secure the invention in place and to provide strength from non-forced entries. In preferred embodiments, the invention will work on a deadbolt assembly that provides a thumb knob or knob that may be associated with rotating the deadbolt to an engage position. Once actuated the invention provides increased security of the deadbolt by immobilizing the turning of the knob and preventing rotation. The present invention can be used on any door or entry barrier with a flat surface interacting with a frame.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
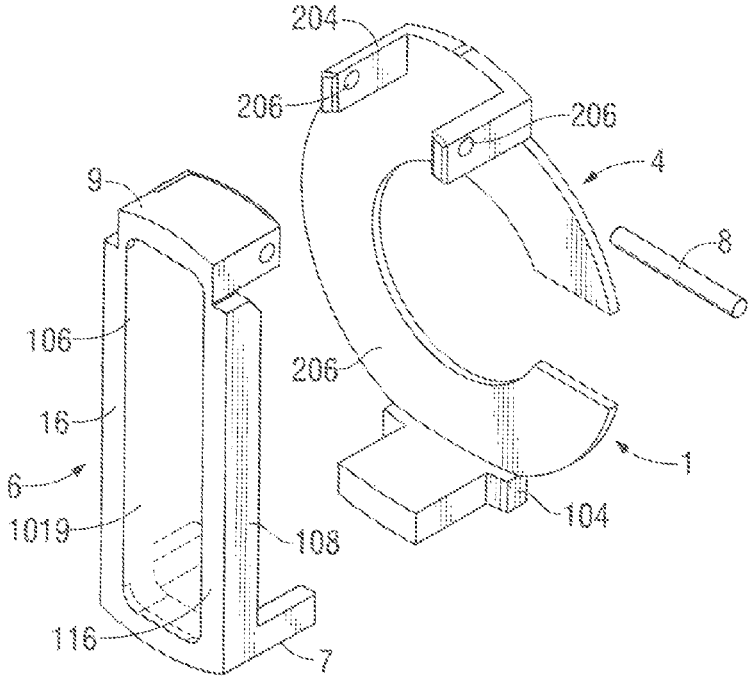
FIG. 1 illustrates one embodiment of the present device in an exploded view.

In the following description, certain details are set forth such as specific quantities, sizes, etc . . . so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain, a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not unless specifically stated in this specification or if the incorporation is necessary for maintaining validity. "Deadbolt" as defined in the present disclosure refers to any locking apparatus that utilizes a bar to prevent the opening of a door or planar surface.

In general, the apparatus, systems and methods of the present disclosure are distinguished from, and advantageous over, other deadbolt locks, and enhancements, that are conventional in the art, because the systems and methods of the present disclosure use a new and novel locking system that utilizes a lock out system that prevents actuating the deadbolt lock even through use of the correct deadbolt lock key.

One or more illustrative embodiments incorporating the invention disclosed, herein are presented below. Applicants have created a revolutionary security system that may be used in conjunction with the existing door lock that consists of a manual turn knob. For example, Applicants have created an improved, security system for an entrance barrier, such as, but not limited to a door, barrier, or door-like structure that contains a manual turn knob. In one embodiment of the present invention, the present invention preferably comprises a security member that is sizable enough to fit behind the turn knob plate, a circular base with a section cut out for easy installation, a hinge mechanism to house the latch arm, an actuating arm for folding over the turn knob to prevent any free movement of the lock turn knob.

Figure 2:
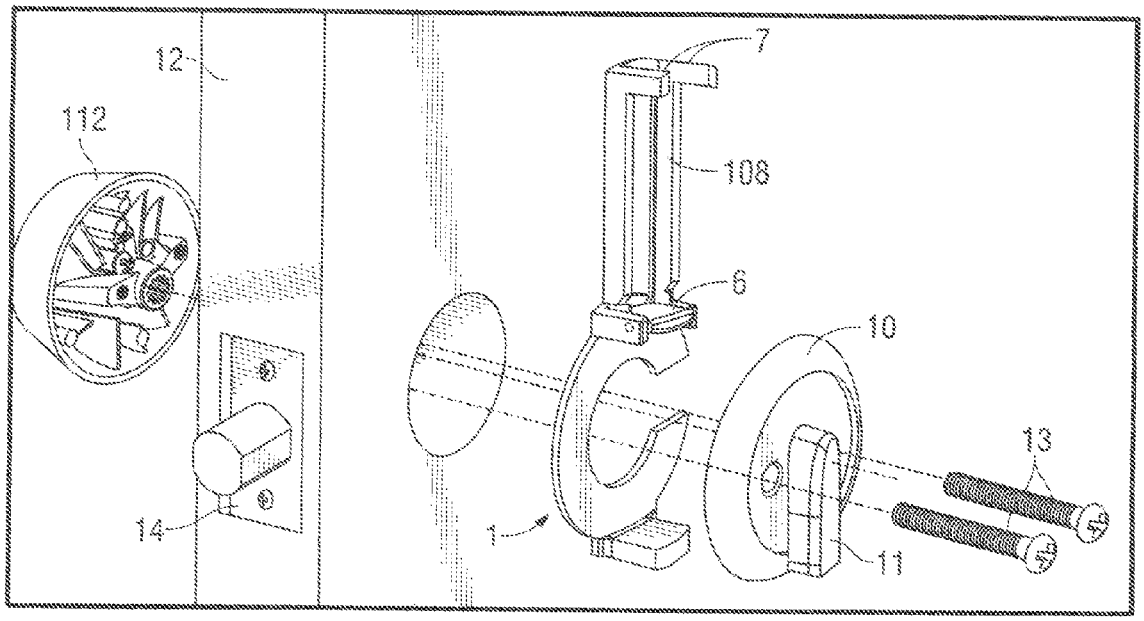
FIG. 2 illustrates one embodiment of the present device in an exploded view as it would be attached to a door or barrier.

FIG. 1 illustrates, one embodiment of the present invention in an exploded view. As illustrated, the novel and inventive system 1 preferably comprises elements that are sized to be used with, a standard turn knob plate 10 for a deadbolt assembly 14. The deadbolt assembly 14, is preferably one of ordinary use in the industry, however; the inventive system 1 can be modified for use with specialized deadbolt assemblies. The materials for constructing the present inventive system 1 can be metals, industrial plastics, or other materials that have sufficient strength to prevent rotation of the deadbolt knob 11, when the actuator arm 6 engages the deadbolt knob 11. In many of the embodiments of the present invention, the individual pieces of the inventive system 1 can be composed of different materials than the other pieces. By way of example, in one embodiment of the present invention, the actuator arm 6 could be composed of brass, whereas the hinge pin 8 could be comprised of steel, however numerous other material combinations are available. As illustrated, the inventive system 1 preferably contains a base plate 4. Base plate 4 is preferably constructed with a flat surface, which in many embodiments is substantially C shaped. However, it is envisioned that different geometric shapes of the base plate 4 can be used with the present invention, including, but not limited to, ovals, triangles, squares and other geometric shapes with an orifice in the center. It is also preferable that base plate 4 is substantially designed for ease of installation, and removal behind the turn knob plate 10 when the device is installed on a door 12 (FIG. 2). In one embodiment of the present invention, the base plate 4 is preferably designed to have a hinge bracket 204 and a actuating arm receiver 104 located preferably distal to each other on the base plate 4.

As shown in FIG. 1, base plate 4, is attached through releasable mechanical attachment to the actuating arm 6. In one embodiment of the present invention, the base plate 4 is preferably designed to have a hinge bracket 204 and a actuating arm receiver 104 located preferably distal to each other on the base plate 4, however the arm receiver 104 and the hinge bracket 204 could be located on various areas of the base plate 4 depending on the location of the deadbolt knob 11. In one embodiment of the present invention, the hinge bracket 204 is preferably constructed to have two orifices 206 running through each arm of the hinge bracket 204. These orifices 206 are preferably designed to allow for a hinge pin 8 to pass through them, but be in releasable communication with the hinge bracket 204, when the improved system 1 is assembled.

As shown in FIG. 1, in one embodiments of the present invention, base plate 4 is attached to the actuator arm 6 through a hinge bracket 204 with a hinge pin 8 running through the hinge bracket 204 and also the bracket attachment extension 9. Actuator arm 6 is preferably comprised of a bracket attachment extension 9, arm prongs 7 and arm base 16. As illustrated, in one embodiment of the present invention, the bracket attachment extension 9 and the arm prongs 7 are preferably located distal from each other on the actuating arm 6. Bracket attachment extension 9, is preferable constructed to be of solid material and to extend from the arm base 16 as preferably as solid mass. In one embodiment of the present invention, bracket attachment extension 9 has an orifice 306 running through it, which can, when the improved system 1 is assembled house a hinge pin 8 in releasable communication within bracket attachment extension 9. It is also preferable that bracket attachment extension 9 is of sufficient length from arm base 16 as to allow for deadbolt turn knob plate 10 to fit between the base plate 4 and the arm base 16 when assembled and engaged, such that the rotational alignment of the hinge of hinge bracket 204 and the bracket attachment extension 9, will operate to move the actuator arm 6 over the dead bolt turn knob 11 without mechanical interference from the knob turn plate 10.

As shown in FIG. 1, in one embodiments of the present invention, actuator arm 6 is also comprised of arm base 16. As illustrated, arm base 16, is preferably constructed two parallel solid bar sides 108 exuding from an arm face plate 116. In one embodiment of the present invention, the arm face plate 116 may be constructed as a solid material piece, or, as illustrated, have an orifice carved out of the face plate 116, such that edges 106 are visible. In one embodiment of the present invention, the orifice allows a user to actually see the deadbolt turn knob 11 in between the solid bar sides 108, when the improved system 1 is in operation and engaged. In several embodiments of the present invention, users could place decorative materials, such as design patterns, team logos, stencils, or any other ornamental materials behind the arm face plate 116 so that they would be visible behind the face plate 116 through the orifice. In several embodiments of the present invention, solid color materials 1019 could be used behind the face plate 116 such that on one side of a material 1019 a color like red, could indicate that the deadbolt turn knob 11 is not covered, and therefore the inventive device 1 is not engaged, and on the other side, a color such as green, would indicate that the inventive device 1 is engaged as the green portion would show when the solid bar sides 108 are fully encompassing the deadbolt knob 11.

Figure 3:
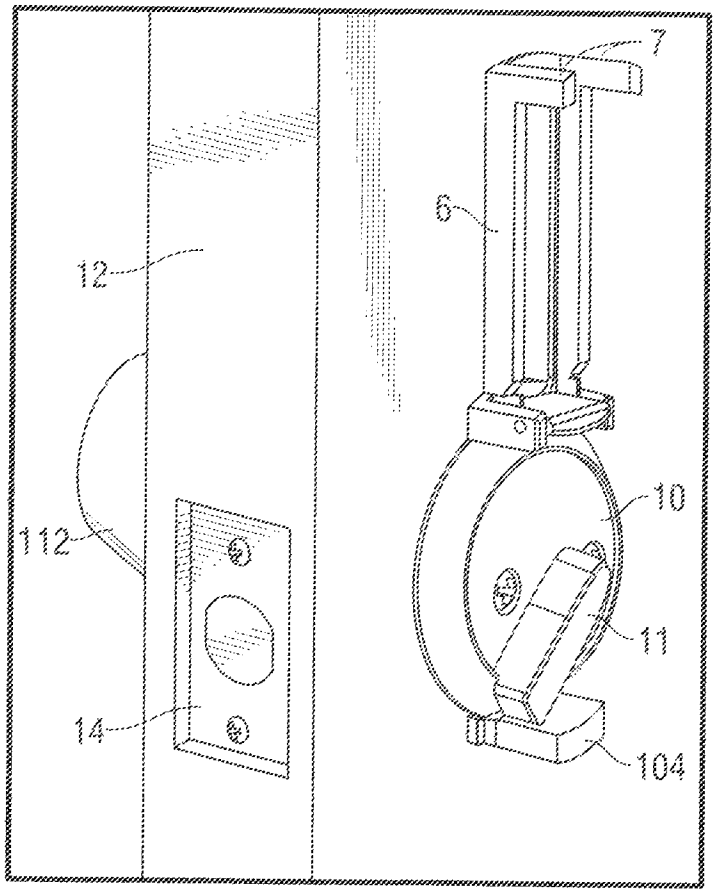
FIG. 3 illustrates one embodiment of the present invention in an assembled view attached to a door or barrier in an open/disengaged position.

As shown in FIG. 3, in one embodiment of the present invention, arm base 16, is preferably constructed two parallel solid bar sides 108 exuding from and behind arm face plate 116. The solid bar sides 108 are preferably constructed to be parallel and be spaced apart a distance such that the solid bar sides 108 would fit snugly over a deadbolt turn knob 11, when the inventive system 1 is operation and a user wishes to engage the deadbolt turn knob 11 to prevent it from rotating. Exuding from the solid bar sides 108 and preferably distal from attachment extension 9 are the arm prongs 7. Arm prongs 7 are preferably of the same width as the solid bar sides 108 and are preferably designed to mechanically and releasably interact with the actuating aim receiver 104 on the base plate 4 when the inventive device is in operation. In one embodiment of the present invention a user can push on the arm prongs 7 in a manner that rotates them in a circular motion downward to move and mechanically interact over the actuating arm receiver 104 therein entrapping the deadbolt knob 11 in order to release the deadbolt turn knob 11 from, entrapment the user need only pull the arm prongs 7 off of the actuating arm receiver 104 and move them in the counter circular pattern about the hinge pin 8 until the deadbolt turn knob 11 can rotate.

It is envisioned that other methods and attachment apparatus can be used to attach the actuator arm 6 to the base plate 4, other than a pin and hinge mechanism, these would include but are not limited to swivels and other rotational hinges.

FIG. 2 illustrates, one embodiment of the present invention in exploded view being attached within a deadbolt assembly 14 to a door 12. For ease of illustration. FIG. 2 does not show the tail piece commonly used with, a deadbolt assembly 14, although the tail piece is commonly known and used in the industry. As illustrated, the novel and improved system 1 is attached directly into the deadbolt assembly 14 behind the key entry mechanism 112 and behind the face of the door 12 adjacent to the key entry mechanism 112. As shown, the base plate 4 is preferably installed behind the turn knob plate 10. It is preferable that the base plate 4 is installed such that the arm receiver 104 is closest to the floor and the bracket attachment extension 9 is furthest from the floor (which, as in most deadbolt assemblies, means that when, the deadbolt is engaged the deadbolt rum knob is usually perpendicular to the floor). However, in several embodiments, the arm receiver 104 and the bracket attachment extension 9 can be installed in a myriad of positions such that the improved system 1 can be actuated to cover the deadbolt turn knob 11 and prevent the deadbolt knobs rotation at a user's discretion, regardless of the engaged orientation of the deadbolt knob 11. In some embodiments of the present invention it is preferable that the base plate 4 is installed such that the arm receiver 104 is furthest from the floor and the bracket attachment extension 9 is nearest to the floor. Also illustrated, are standard bolts 13 for a deadbolt assembly 14 which are used to attach the inventive system 1 into a standard deadbolt assembly 14. As shown, in one embodiment, the base plate 4 is thin enough in width on the "C" portion to allow the bolts 13 to pass through the center of the base plate 4 without any base plate 4 interaction. Longer bolts 13 can be used depending on the actual thickness of the base plate 4. In some embodiments of the present invention the base plate 4 may have one or more orifices to allow for "C" portion to have increased width from the base plate 4 outer edge, but also allow for the bolts 13 to pass through the orifices when the inventive system 1 is assembled with the deadbolt assembly 14.

FIG. 3 illustrates, one embodiment of the present invention in assembled view having been attached with a deadbolt assembly 14 to a door 12. As illustrated, the actuator arm 6 is in the upright position, which allows for the deadbolt turn knob 11 to be rotated in the manner that is customary for a deadbolt assembly 14. As shown the actuator arm 6 is not engaging the deadbolt knob 11, and although illustrated in the position in which the actuator arm 6 is flush to the door 12, the actuator arm 6 need not be positioned flush with the door 12 when not in use and can be in a variety of positions relative to the axis of the hinge pin 8.

Figure 4:
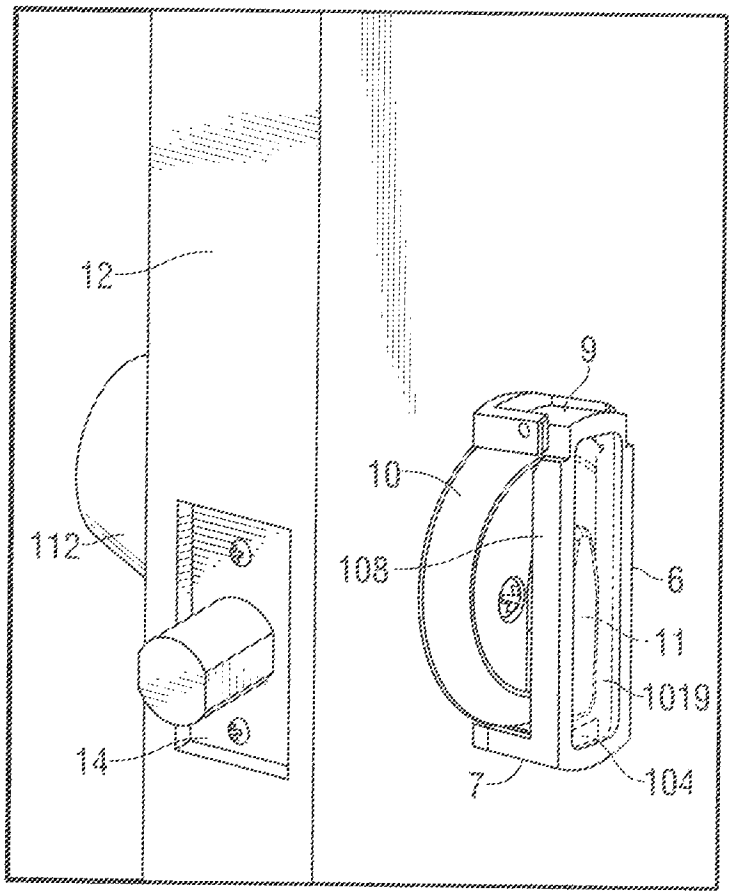
FIG. 4 illustrates an embodiment of the present invention in an assembled view attached to a door or barrier in a closed/engaged position.

FIG. 4 illustrates, one embodiment of the present invention in assembled view having been attached with a deadbolt assembly 14 to a door 12. As illustrated, the actuator arm 6 is in the engaged position, which prevents the deadbolt turn knob 11 from being rotated in the manner that is customary for a deadbolt assembly 14. When engaged the arm prongs 7 are moved to a position around the arm receiver 104 such that the two are mechanically, but releasably engaged with each other. In the engaged position of the inventive system 1, the solid bar sides 108 form a reinforced side barrier to the deadbolt turn knob 11 preventing the deadbolt turn knob from being rotated either clockwise or counterclockwise. The barrier caused by the solid bar sides 108 is preferably so strong as to prevent the rotation of the deadbolt turn knob 11 even when the correct key is used in the key entry mechanism 112.

In one embodiment of the present invention, the present invention is assembled as follows: the base plate 4 is attached to the actuator arm 6 by lining up the actuator arm 6 via the bracket attachment extension 9 such that the orifice of the hinge bracket 204 lines up with the orifice 306 of the bracket attachment extension 9. At this point, the hinge pin 8 is inserted into the orifice 206 and through the orifice 306 into the other corresponding orifice 206 on the other side of the bracket attachment extension 9, therein securing the actuator arm 6 to the base plate 4.

In one embodiment of the present invention, the present invention is assembled with an existing door or barrier as follows: the deadbolt assembly 14 is disassembled by, preferably removing or loosening bolts 13. The deadbolt turn knob plate 10 and deadbolt turn knob 11 are either fully pulled away from door 12 or partially pulled away. The base plate 4 of the inventive system 1 is then placed behind the deadbolt turn knob plate 10, between the deadbolt turn knob plate 10 and the door 12. It is preferable that the actuator arm 6 is in a position at this time in which it is not interfering with the deadbolt turn knob plate 10 being reattached to the rest of the deadbolt assembly 14. It is also preferable that the base plate 4 is lined up with the deadbolt turn knob plate 10 such that when the deadbolt turn knob 11 is in the position that the deadbolt is fully extended into the door frame, that the bottom of the deadbolt turn knob 11 would be parallel to the solid bar sides 108 so as to prevent deadbolt turn knob 11 rotation when the inventive system 1 is engaged by a user. Once the base plate 4 is properly aligned, the used can then reassemble the deadbolt assembly 14 by retightening or inserting and tightening bolt 13 through the deadbolt turn knob plate 10 and into the key entry mechanism 112, with the base plate 4 assembled behind the deadbolt turn knob plate 10. In another embodiment of the present invention, the invention is installed by loosening the two bolts 13 by roughly 50% or enough so the base plate 4 can slide into place between the turn knob plate 10 and the door 12 on the existing deadbolt assembly 14. The inventive system 1 is then placed directly behind the turn knob plate 10 and centered to fit so that the actuator arm 6 can securely fasten the deadbolt turn knob 11 into place. Once the invention is in place, it may be secured by re-tightening the two bolts 13 on the turn knob plate 10.

In one embodiment of the present invention the present invention operates in the following manner; if a user want to prevent unwanted entry through the door 12 on which the inventive system 1 is installed, the user need, only extend the deadbolt by rotating the deadbolt knob 11, then the user need move the actuator arm 6 into position, over the deadbolt turn knob 11 such that the deadbolt turn knob 11 is between the solid bar sides 108 so as to prevent deadbolt turn knob 11 rotation and therein retraction of the deadbolt from the door frame. In order to insure that the solid bar sides 108 are properly in place when engaged, the arm prongs 7 should be in releasable mechanical communication with the arm receiver 104 such that the end of the arm receiver 104 distal to the base 4, should touch the back of the face plate 116. In order to disengage the present inventive device the user should pull the actuator arm 6 such that the arm prongs 7 disengage the arm receiver 104 thereby removing the solid bar sides 108 which form the barrier to the rotation of the turn knob 11.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

What is claimed is the following:

1. An improved security locking system for a deadbolt assembly comprising;

a base plate;

said base plate further comprising; an arm receiver exuding from the base plate and a hinge bracket with two orifices exuding from the base plate;

said hinge bracket further comprising two arms with said orifices;

an actuator arm;

said actuator arm further comprising; a bracket attachment extension with a solid body, an arm face plate body, and solid bar sides with arm prongs;

said bracket attachment extension further comprising, an orifice running through its solid body;

a hinge pin;

wherein said actuator arm is attached to said base plate by aligning said orifice of said bracket attachment extension with said orifices of said hinge bracket and releasably inserting the hinge pin into said orifice of said bracket attachment extension with said orifices of said hinge bracket, thereby placing the actuator arm and the base plate in rotational mechanical communication.

2. The improved security locking system for a deadbolt assembly of claim 1 further comprising;

said arm face plate body has an orifice.

3. The improved security locking system for a deadbolt assembly of claim 2 further comprising;

visual materials placed behind said arm face plate body with said orifice in said arm face plate body so they are visible.

4. A method of installing an improved security locking system on a door with a deadbolt assembly comprising;

providing a deadbolt assembly with securing bolts, a deadbolt and a turn knob late;

loosening the securing bolts of the deadbolt assembly in a door;

sliding said base plate of the improved security locking system of claim 1 between the turn knob plate of said deadbolt assembly and said door;

said turn knob plate further comprising a turn knob;

centering the improved locking system of claim 1 so that said actuator arm can cover the turn knob of said deadbolt assembly over said turn knob when said turn knob of said deadbolt assembly is engaged to a locking position and extends the deadbolt of said deadbolt assembly; and securing the improved security locking system of claim 1 by tightening said securing bolts on said deadbolt assembly, therein reassembling said deadbolt assembly.

5. A method of engaging an improved security locking system on a door with a deadbolt assembly comprising;

closing a door with the improved security locking system of claim 1 already installed;

extending a deadbolt of said deadbolt assembly by rotating a turn knob;

rotating said actuator arm into position over said turn knob such that said knob is firmly secured between the solid bar sides;

wherein, said turn knob is prevented from rotating.

6. The method of engaging an improved security locking system on a door with a deadbolt assembly of claim 5 further comprising;

rotating the actuator arm until the arm prongs of said solid bar sides are adjacent and in mechanical communication with said arm receiver.

* * * * *